US007678998B2

(12) United States Patent
Lind et al.

(10) Patent No.: US 7,678,998 B2
(45) Date of Patent: Mar. 16, 2010

(54) CABLE ASSEMBLY

(75) Inventors: Howard Lind, Porter Ranch, CA (US); John Palahnuk, Valencia, CA (US)

(73) Assignee: Cicoil, LLC, Valencia, CA (US)

( * ) Notice: Subject to any disclaimer, the term of this patent is extended or adjusted under 35 U.S.C. 154(b) by 0 days.

(21) Appl. No.: 12/119,199

(22) Filed: May 12, 2008

(65) Prior Publication Data

US 2008/0289852 A1 Nov. 27, 2008

Related U.S. Application Data

(60) Provisional application No. 60/931,179, filed on May 21, 2007.

(51) Int. Cl.
*H01B 7/08* (2006.01)

(52) U.S. Cl. ..... 174/117 F

(58) Field of Classification Search ..... 174/115, 174/117 F, 117 FF
See application file for complete search history.

(56) References Cited

U.S. PATENT DOCUMENTS 2,158,867 A * 5/1939 Schwabacher ..... 174/117 F
3,502,791 A * 3/1970 Dahlstrom ..... 174/115
3,971,105 A 7/1976 Caveney
4,011,360 A * 3/1977 Walsh ..... 428/402
4,188,004 A 2/1980 Fulton et al.
4,234,146 A 11/1980 Shima et al.
4,269,380 A 5/1981 Shima et al.
4,299,362 A 11/1981 Buluschek et al.
4,308,421 A * 12/1981 Bogese, II ..... 174/32
4,315,662 A 2/1982 Greenwood et al.
4,356,599 A 11/1982 Larson et al.
4,447,032 A 5/1984 Olsen
4,447,934 A 5/1984 Anscher
4,472,598 A 9/1984 Boyd et al.
4,606,595 A 8/1986 Dola
4,700,023 A 10/1987 Hillmann et al.
4,824,057 A 4/1989 Suprono
4,911,210 A 3/1990 Hillegonds
4,933,513 A * 6/1990 Lee ..... 174/115
4,990,098 A 2/1991 Neidecker et al.
5,025,115 A * 6/1991 Sayegh et al. ..... 174/117 F
5,123,618 A 6/1992 Guterman et al.
5,162,611 A * 11/1992 Nichols et al. ..... 174/36
5,188,542 A 2/1993 Ballman
5,354,020 A 10/1994 Richards
5,428,187 A * 6/1995 Crane et al. ..... 174/36
5,725,185 A 3/1998 Auclair
5,820,083 A 10/1998 Geiger
5,902,961 A 5/1999 Viklund et al.
5,904,581 A 5/1999 Pope et al.
5,937,950 A 8/1999 Adams et al.
5,949,020 A 9/1999 Mitchell et al.
5,967,468 A 10/1999 Veghte et al.

(Continued)

*Primary Examiner*—Chau N Nguyen
(74) *Attorney, Agent, or Firm*—Edmond A. DeFrank

(57) ABSTRACT

A cable assembly is provided including an encapsulated cable having one or more elements and an intermediary section. The encapsulated cable extends along a length direction. The intermediary section extends along the length direction and is attached along a length of the encapsulated cable and extends outwardly therefrom. The intermediary section is configured to receive one or more fasteners for securing the cable assembly to an external surface without the one or more fasteners contacting the one or more elements.

18 Claims, 7 Drawing Sheets

U.S. PATENT DOCUMENTS 5,973,268 A * 10/1999 Cheng ..... 174/112
6,006,000 A * 12/1999 Tuttlebee ..... 385/114
6,089,892 A 7/2000 Snow et al.
6,135,781 A 10/2000 Pope et al.
6,311,935 B1 11/2001 Mullen, Jr.
6,326,547 B1 12/2001 Saxby et al.
6,346,676 B1 2/2002 Caldwell
6,398,149 B1 6/2002 Hines et al.
6,416,339 B1 7/2002 Snow et al.
6,438,309 B1 8/2002 Franz
6,438,311 B1 8/2002 Zarnowitz
6,494,726 B1 12/2002 Auclair
6,515,224 B1 2/2003 Pedro
6,530,546 B1 3/2003 Cyrell
6,539,161 B2 3/2003 Holman et al.
6,719,585 B2 4/2004 Egbert
6,747,210 B2 6/2004 Chen
6,759,589 B1 7/2004 VanderVelde
6,766,093 B2 7/2004 McGrath et al.
6,768,858 B2 7/2004 Tinucci et al.
6,809,258 B1 10/2004 Dang et al.
6,884,942 B2 4/2005 McGrath et al.
6,890,200 B1 5/2005 Wu
6,923,679 B1 8/2005 Wu
6,946,599 B2 9/2005 VanderVelde
6,969,802 B1 11/2005 George
6,972,367 B2 12/2005 Federspiel et al.
6,972,368 B2 12/2005 VanderVelde
6,977,055 B2 12/2005 Gallant et al.
7,007,931 B2 3/2006 Tobinai
7,041,903 B2 5/2006 Odahara et al.
7,134,633 B2 11/2006 Logan
7,137,181 B2 11/2006 Ifort
7,163,180 B2 1/2007 Sivahop

* cited by examiner

CABLE ASSEMBLY

CROSS-REFERENCE TO RELATED APPLICATION(S)

This application claims priority to and the benefit of U.S. Provisional Patent Application No. 60/931,179 filed on May 21, 2007, the entire content of which is incorporated herein by reference.

BACKGROUND OF THE INVENTION

1. Field of the Invention

The present invention relates to cable assemblies, and more particularly, to flat, flexible, encapsulated cables used to make electrical and/or other connections in industrial equipment, process automation, robotics, medical, aerospace, weapons, and satellite applications.

2. Description of Related Art

A flat cable assembly, also referred to as a ribbon cable, includes encapsulated elements such as conducting wires extending roughly parallel to each other. When the cable assembly is laid flat, the conducting wires extend roughly parallel to each other on roughly a single plane. The conducting wires, which may themselves be insulated, are encapsulated by molding, extrusion or some other process in a plastic sheath. The plastic is typically a silicone, but it can also be a urethane, a polytetrafluoroethylene (sold by Dupont under the trademark Teflon), or a polyvinyl chloride (PVC) depending upon the application. Because the cable assembly is normally made of a flexible material, it can be bent or twisted at any of various points along the length of the cable assembly.

The cable assembly provides for termination of the conducting wires. The terminations may be at a crimp, a solder bucket connection, or to insulation displacement connectors (or IDC connectors) at which the cable assembly is forced onto a row of forked contacts. The conducting wires are usually terminated at both ends of the cable assembly using HDC connectors. However, only one end of the cable assembly may be IDC terminated, with the other end being terminated, for example, at a regular crimp or solder bucket connection.

To conserve space and encapsulation material, the conducting wires in a cable are positioned side-by-side in close proximity to one another. Thus, a fastener cannot be placed through the cable without risking damage to one or more of the conducting wires. Securing the cable assembly to an external object or surface can be achieved using a separate cable clamp or tie that contacts or wraps around the cable assembly at top and bottom edge portions of the cable assembly. Such securing of the cable assembly can also be achieved using one or more separate cable clips, each of which is configured to secure a top or bottom edge portion of the cable assembly to the object or surface.

Cable having a round cross section may also have clamping down issues when it is being used to make connections in various applications. Separate clips or other fastener elements need to be used to permit the use of fasteners for cable management.

Alternatively, separate channels or conduits are provided to support the cables being used and provide for cable management. Such channels or conduits add to the cost of equipment however and can add to the difficulty and complexity of assembly due to the need to run the cables through the channels or conduits.

Another example of a securing mechanism is disclosed in Gallant et al., "Securing Electrical Conductors," U.S. Pat. No. 6,977,055, Dec. 20, 2005, which is herein incorporated by reference. Gallant et al. discloses fastener elements that are arranged and constructed to engage a further set of mating fastener elements provided on a supporting surface. The fastener elements are used to secure a cable or flexible circuit board to the supporting surface. As disclosed in Gallant et al., the fastener elements can be loop-engageable fasteners and/or loops.

As such, there is a need for a cable assembly which can be secured to an object or surface without using separate clips or clamps that wrap around or contact top and/or bottom edge portions of the cable assembly and in most cases without requiring mating fastener elements to be provided on the object or surface. There is also a need for a cable assembly which may allow for the elimination of separate channels or conduits used for cable management.

SUMMARY OF THE INVENTION

In an exemplary embodiment of the present invention, a cable apparatus includes a first encapsulated plurality of elements extending along a length direction. The cable apparatus also includes an intermediary section extending along the length direction and having a first edge and a second edge. The first edge is adjacent to the first encapsulated elements. The cable apparatus may also include a second encapsulated plurality of elements extending along the length direction. The second edge of the intermediary section may be adjacent to the second encapsulated elements. The first edge and the second edge of the intermediary section are spaced apart to define an area configured to receive one or more fasteners configured to secure the cable apparatus to an external surface.

The intermediary section may include a first barrier protruding from the intermediary section along a height direction and extending along the first edge of the intermediary section and a second barrier protruding from the intermediary section along the height direction and extending along the second edge of the intermediary section.

The intermediary section may include a band extending along the length direction.

In an exemplary embodiment of the present invention, a cable apparatus is provided having a first set of elements extending in a length direction, a second set of elements extending in the length direction, encapsulation material encapsulating the first set of elements and the second set of elements; and an intermediary section extending between the first set of elements and the second set of elements. The intermediary section is configured to receive one or more fasteners for securing the cable apparatus to an external surface without the one or more fasteners contacting the first set of elements or the second set of elements.

In one embodiment, the encapsulation material is selected from the group consisting of silicone, urethane, polyvinyl chloride, and polytetrafluoroethylene and the intermediary section is formed of the encapsulation material.

In one embodiment, the first set of elements and the second set of elements each include at least one of a wire of an electrically conductive metal.

In one embodiment, the first set of elements and the second set of elements each include a plurality of wires, the plurality of wires being spaced from each other in a width direction, perpendicular to the length direction.

In one embodiment, a first indentation extends in the length direction between the intermediary section and the first set of elements. A second indentation extends in the length direction between the intermediary section and the second set of elements. The first indentation and the second indentation have a narrower thickness than the intermediary section.

In one embodiment, a groove extends down a center of the intermediary section for guiding proper placement of the one or more fasteners and for allowing the intermediary section to be easily separated along the groove.

In one embodiment, a first barrier protrudes from the intermediary section and extends in the length direction along a first edge of the intermediary section. A second barrier protrudes from the intermediary section and extends in the length direction along a second edge of the intermediary section.

In one embodiment, the first barrier, the second barrier, and/or the intermediary section is ruled to facilitate positioning the one or more fasteners.

In one embodiment, a band is located within the intermediary section and extends in the length direction.

In one embodiment, the encapsulation material is formed of silicone and the band is a fiberglass reinforced silicone strip.

In one embodiment, the intermediary section is transparent and the band is ruled to facilitate positioning of the one or more fasteners.

In one embodiment, the band includes a plurality of holes and/or markers for guiding installation of the one or more fasteners.

In one embodiment, a plurality of additional sets of elements extend in the length direction. The encapsulation material encapsulates the plurality of additional sets of elements. The plurality of additional intermediary sections extend between each of the plurality of additional sets of elements, and between the second set of elements and one of the plurality of additional sets of elements. The plurality of additional intermediary sections are configured to receive one or more fasteners for securing the cable apparatus to an external surface without the one or more fasteners contacting the second set of elements or the plurality of additional sets of elements.

In one embodiment, each of the intermediary section and the plurality of additional intermediary sections has a recess, indentation, or groove extending in the length direction for facilitating splitting and branching the cable apparatus into an array.

In one embodiment, a plurality of additional bands extend in a length direction, each of the plurality of additional bands being located in a respective one of the plurality of additional intermediary sections.

In an exemplary embodiment of the present invention, a cable apparatus is provided including at least three sets of elements extending in a length direction; encapsulation material encapsulating the at least three sets of elements, the encapsulation material being formed of silicone; a plurality of intermediary sections extending between each of the at least three sets of elements, the plurality of intermediary sections being formed of silicone; and a fiberglass reinforced silicone strip within each of the plurality of intermediary sections, the fiberglass reinforced silicone strip extending in the length direction. The plurality of intermediary sections are configured to receive one or more fasteners extending through the fiberglass reinforced strip within each of the plurality of intermediary sections, the one or more fasteners for securing the cable apparatus to an external surface without the one or more fasteners contacting the at least three sets of elements.

In one embodiment, a plurality of indentations extend in the length direction between each of the plurality of intermediary sections and a respective one of the at least three sets of elements. The plurality of indentations have a narrower thickness than the plurality of intermediary sections. The plurality of indentations facilitate splitting and branching the cable apparatus into an array.

In one embodiment, the plurality of intermediary sections each have a recess, indentation, or groove extending in the length direction for facilitating splitting and branching the cable apparatus into an array.

In one embodiment, a plurality of barriers protrude from the plurality of intermediary sections and extending in the length direction along edges of each of the plurality of intermediary sections.

In one embodiment, the plurality of barriers, the plurality of intermediary sections, and/or the fiberglass reinforced silicone strip within each of the plurality of intermediary sections are ruled to facilitate positioning the one or more fasteners.

In an exemplary embodiment of the present invention, a cable assembly is provided including an encapsulated cable having one or more elements and extending along a length direction; and an intermediary section extending along the length direction and attached along a length of the encapsulated cable and extending outwardly therefrom. The intermediary section is configured to receive one or more fasteners for securing the cable assembly to an external surface without the one or more fasteners contacting the one or more elements.

In one embodiment, said one or more elements are a plurality of elements. The plurality of elements are aligned substantially parallel to one another in a same plane.

In one embodiment, the intermediary section is integrally formed with the encapsulated cable.

In one embodiment, the cable is encapsulated in a silicone material and the intermediary section is composed, at least in part, of a silicone material.

In one embodiment, the intermediary section includes an encapsulated band extending in the length direction.

In one embodiment, the band of the intermediary section is made of fiberglass reinforced silicone.

In one embodiment, a second intermediary section extends along the length direction and is attached along a length of the encapsulated cable and extends outwardly therefrom. The intermediary section and the second intermediary section are in a same plane. The second intermediary section is configured to receive one or more fasteners for securing the cable assembly to the external surface without the one or more fasteners contacting the one or more elements.

BRIEF DESCRIPTION OF THE DRAWINGS

The above and other embodiments of the present invention will be appreciated as the same become better understood with reference to the specification, claims and appended drawings wherein:

DETAILED DESCRIPTION

The detailed description set forth below in connection with the appended drawings is intended as a description of exemplary embodiments of cable assemblies provided in accordance with the present invention and is not intended to represent the only forms in which the present invention may be constructed or utilized. The description sets forth the features of the cable assemblies of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Embodiments of the present invention are directed to a cable apparatus providing an intermediary location at which one or more fasteners may be attached. The intermediary location is provided by an intermediary section of the cable assembly located along side of or between other sections of the cable assembly.

Figure 1:
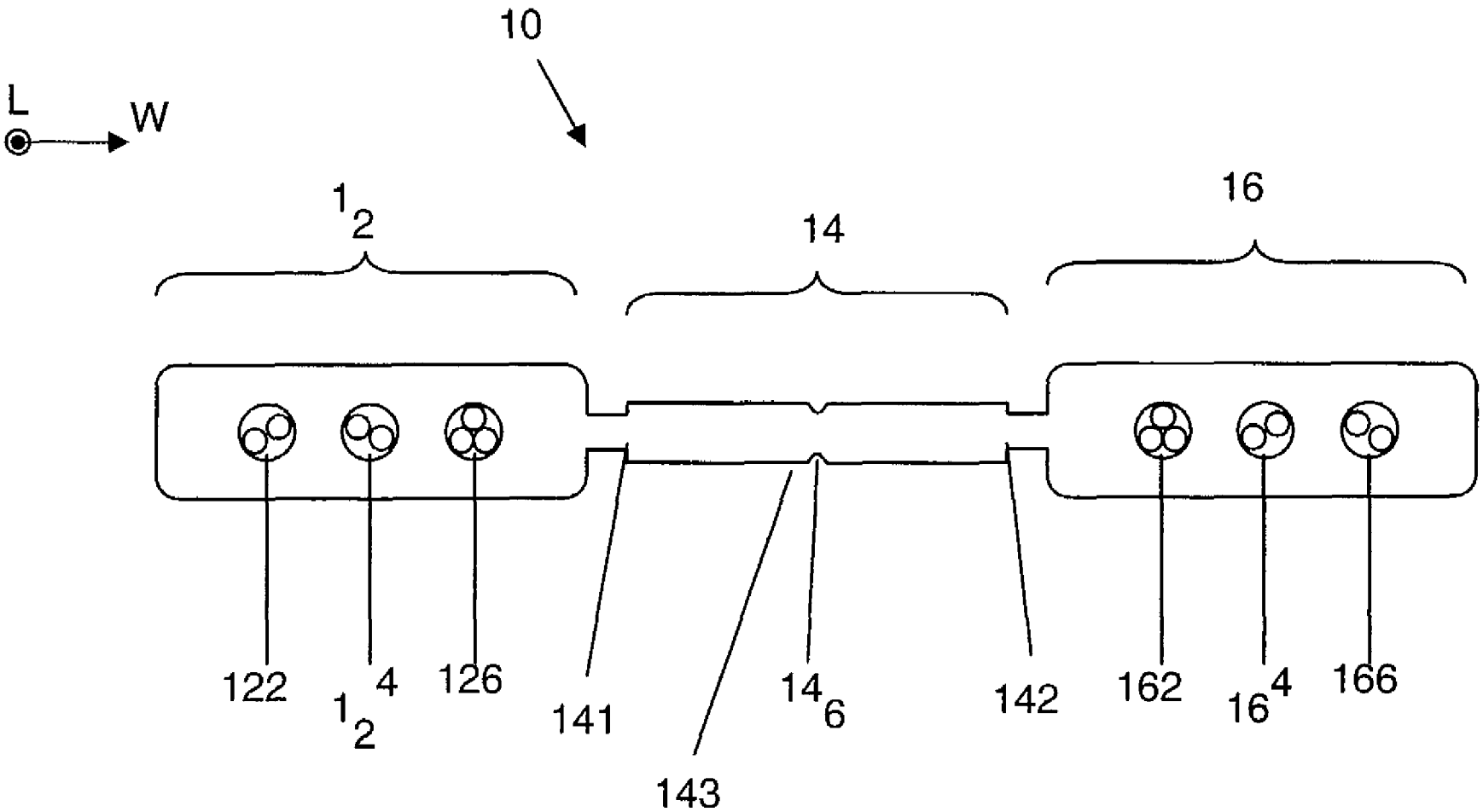
FIG. 1 illustrates a cross-sectional view of a cable apparatus according to an embodiment of the present invention.

With reference to FIG. 1, according to one embodiment of the present invention, a cable apparatus 10 includes encapsulated elements 12 extending along a length direction L, roughly perpendicular to the plane of FIG. 1. The encapsulated elements may be wires (shielded or non-shielded), cables (such as those containing multiple conductors), fiber optics, tubing (vacuum or pressurized), other linear elements such as for cable identification, or any combination of one or more of these elements. The embodiment of FIG. 1 shows the elements as conducting wires but the invention should not be understood as being so limited. Each of the conducting wires 12 is for conducting electricity and/or electrical signals and may be made from an electrically conductive metal such as copper, aluminum, or gold. The conducting wires 12 may be bundled into two or more bundles 122, 124, 126. The wires or bundles may themselves be insulated. The bundles 122, 124, 126 may be spaced apart from one another at a certain distance, or pitch. The conducting wires 12 are encapsulated in a flexible material such as silicone, urethane, polyvinyl chloride (PVC), or polytetrafluoroethylene. Other encapsulating materials may also be used depending upon the application for the cable.

In the embodiment of FIG. 1, elements 12 and 16 are shown arranged as a flat cable. However, it should be understood that either or both of elements 12 or 16 may also be arranged or comprise a round cable.

The cable apparatus 10 also includes an intermediary section 14 extending along the length direction L. The intermediary section 14 is made from a flexible material such as silicone, urethane, PVC, or polytetrafluoroethylene. The intermediary section 14 has a first edge 141 and a second edge 142. The first edge 141 is adjacent to the encapsulated conducting wires 12. The second edge 142 is adjacent to the encapsulated conducting wires 16. An indentation is between the intermediary section 14 and the encapsulated conducting wires 12 and between the intermediary section 14 and the encapsulated conducting wires 16. The indentation sections have a thickness less than the intermediary section 14 for allowing the intermediary section 14 to be easily separated from adjacent encapsulated conducting wires 12 or 16 by tearing or through the use of a razor knife or some other cutting tool.

For ease of manufacture, the intermediary section 14 may be made of the same material as is used to encapsulate the conducting wires and may be formed at the same time and using the same process as is used to encapsulate the wires. In this way, the intermediary section 14 is made as an integral portion of the cable structure. However, the intermediary section 14 may also be made of any compatible material and may be joined to the cable through a welding or other process in a separate manufacturing step.

The cable apparatus 10 may also include encapsulated elements such as, for example, conducting wires 16 extending along the length direction L. Similar to the conducting wires 12, each of the conducting wires 16 is for conducting electricity and/or electrical signals and may be made from an electrically conductive metal such as copper, aluminum, or gold. The conducting wires 16 may be divided into two or more bundles 162, 164, 166, and may also be themselves insulated. The bundles 162, 164, 166 may be spaced apart from one another at a certain distance, or pitch. The conducting wires 16 are encapsulated in a flexible material such as silicone, urethane, PVC, or polytetrafluoroethylene.

The second edge 142 of the intermediary section 14 is adjacent to the second encapsulated conducting wires when they are included. Again, the second set of encapsulated wires may be formed integrally with the intermediary section, and may be made of the same or a compatible material. The first edge 141 and the second edge 142 of the intermediary section 14 are spaced apart from each other to define an area 143 configured to receive one or more fasteners, such as screws, studs, tacks, nails, rivets, staples, or the like. The fasteners are installed at the intermediary section 14 to puncture at least one surface of the area 143. The fasteners thereby secure the area 143 to an external object or surface. Accordingly, the intermediary section 14 and the cable assembly 10, as well, are also secured to the external object or surface. Because the edges 141, 142 are spaced (i.e., the area 143 is sized) to receive the fasteners, the fasteners do not come into contact with the conducting wires 12, 16 even when the fasteners puncture at least one surface of the area 143. As such, none of the conducting wires 12, 16 is shorted by the fasteners when the fasteners are installed. The fasteners may be a screw or a screw-like device. However, any fasteners suitable for securing the cable assembly 10 to the external surface may be used.

With reference to FIG. 1, the intermediary section 14 may be located at or about the center of the cable assembly 10 with respect to the width direction W. It may also be located at one edge of the cable assembly. It may also be located intermittently at a predetermined distance along the length of cable assembly 10. However, embodiments of the present invention are not limited thereto. The intermediary section may include a groove or recess 146 running down the middle or center of the section lengthwise to serve as a guide for proper placement of fasteners. The groove or recess may also be provided so as to allow the cable assembly to be more easily torn or separated into two pieces, each piece having a side section 14 extending outward therefrom. Grooves or recesses may also be provided at one or both of edges 141 and 142 (FIG. 1) to allow for tearing or separation of the cable into two pieces, one having a side section extending outward therefrom and the other not. Openings may also be formed along the length of the intermediary section to facilitate use of fasteners.

Figure 2:
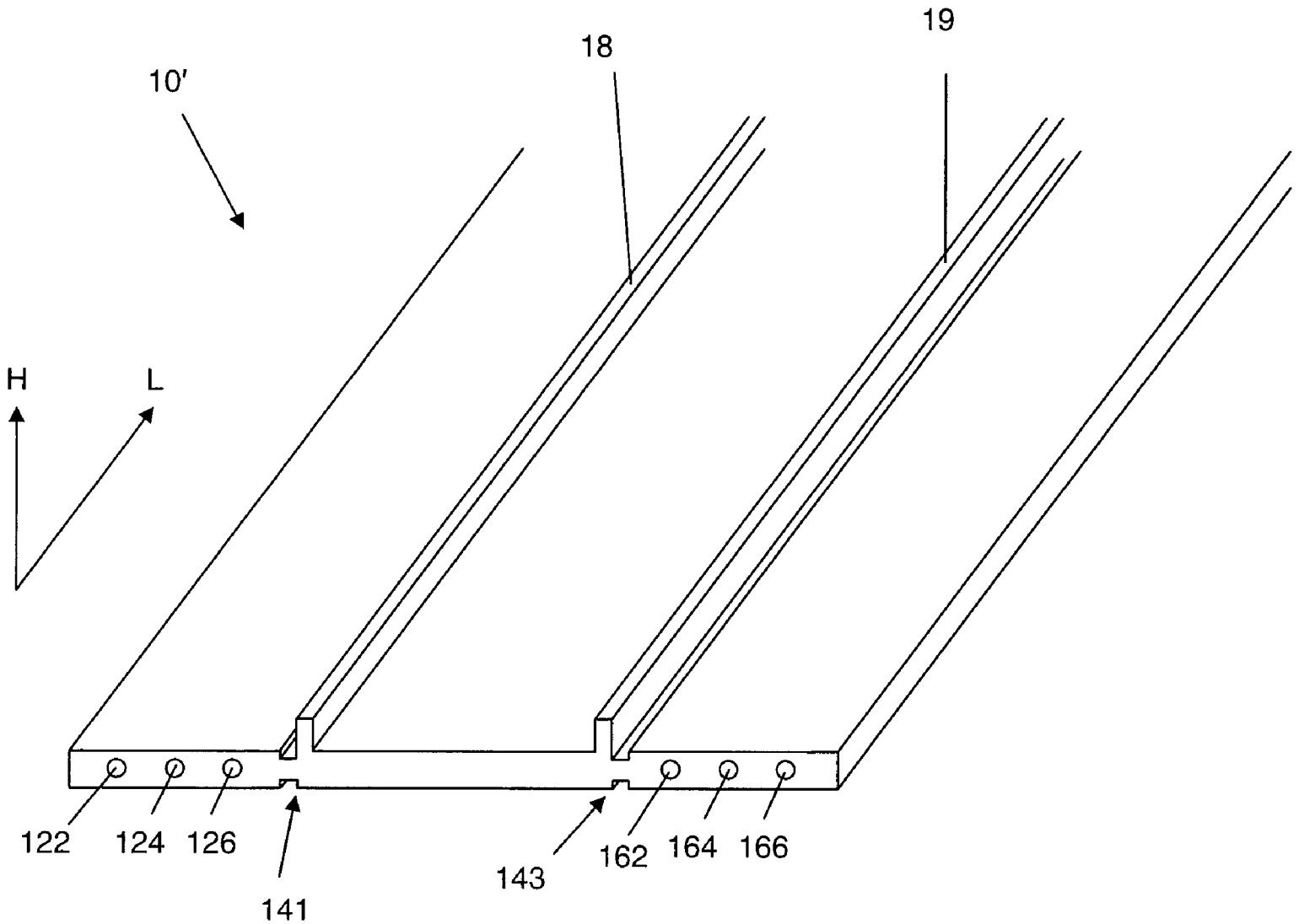
FIG. 2 illustrates a perspective view of a cable apparatus according to another embodiment of the present invention.

With reference to FIG. 2, according to another embodiment of the present invention, the intermediary section 14 of cable assembly 10' may include a barrier 18 protruding from the intermediary section 14 along a height direction H and extending along the first edge 141 of the intermediary section 14. The intermediary section 14 may also include a barrier 19 protruding from the intermediary section 14 along the height direction H and extending along the second edge 142 of the intermediary section 14. The barriers 18, 19 guide installation of the fasteners at the area 143. The presence of the barriers 18, 19 reduces the likelihood that, during installation of the fasteners, one or more of the fasteners will be caused to go outside of the area 143. For example, the presence of the barrier 18 reduces the likelihood that a fastener will be caused to be driven towards conducting wires 122, 124, 126 and to contact the wire(s), thereby shorting the wire(s). The barriers and/or intermediary section may also be ruled to aid in the positioning of fasteners along the length of the cable.

Figure 3:
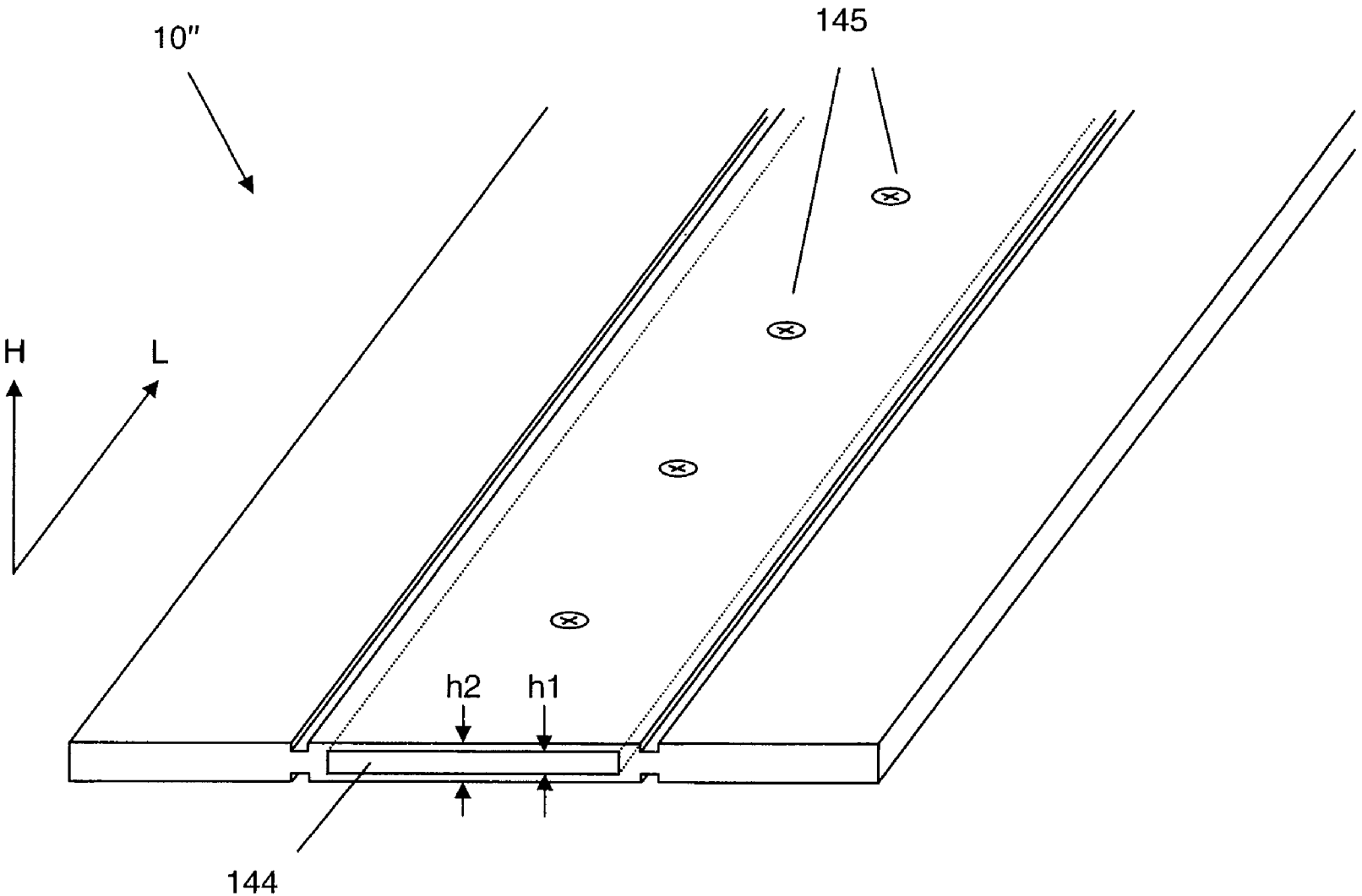
FIG. 3 illustrates a perspective view of a cable apparatus according to another embodiment of the present invention.

With reference to FIG. 3, according to another embodiment of the present invention, the intermediary section 14 of cable assembly 10" may include a band 144 having a height h1 which is less than a height h2 of the intermediary section 14. In an exemplary embodiment, the intermediary section 14 is made of a transparent material such that the band 144 is viewable. The band 144 may include a plurality of holes or may be labeled with one or more markers 145 along the length of the band 144. The holes/markers 145 guide installation of the fasteners at certain locations of the area 143. For example, holes/markers 145 may be spaced at certain locations to facilitate installation of the fasteners at corresponding locations of the area 143. The band may also be ruled to aid in the positioning of fasteners along the length of the cable.

The band 144 may be made of substantially the same flexible material as the intermediary section 14. In a further embodiment, the band 144 is constructed of a less flexible (i.e., more rigid) material than the intermediary section 14 such that the band 144 lends additional structural support to the intermediary section 14. In another exemplary embodiment, the band 144 is a fiberglass reinforced silicone strip. The fiberglass reinforced silicone strip would adhere and bond to the silicone encapsulation material and would allow the cable to be flexible, but not stretchable. That is, the fiberglass reinforced silicone stripe would be less likely to tear or to stretch once fastened if a force were applied on the cable.

Figure 4:
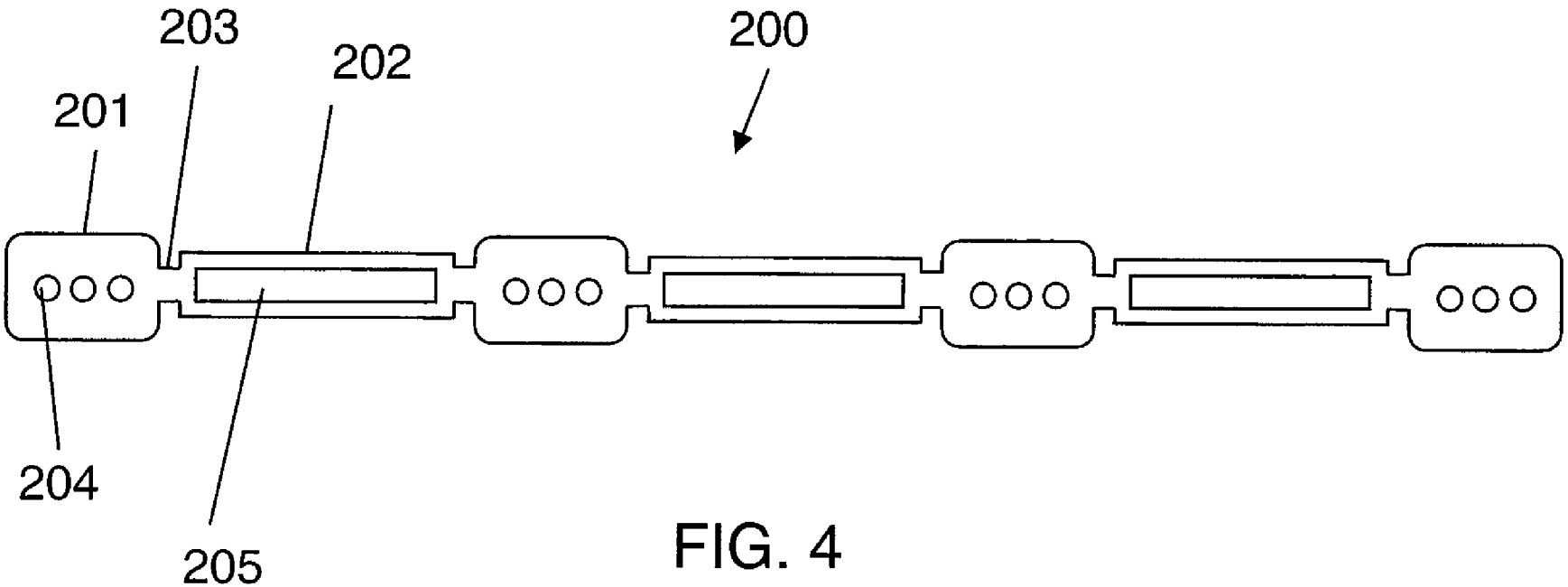
FIG. 4 illustrates a cross-sectional view of a cable apparatus according to yet another embodiment of the present invention.
Figure 5:
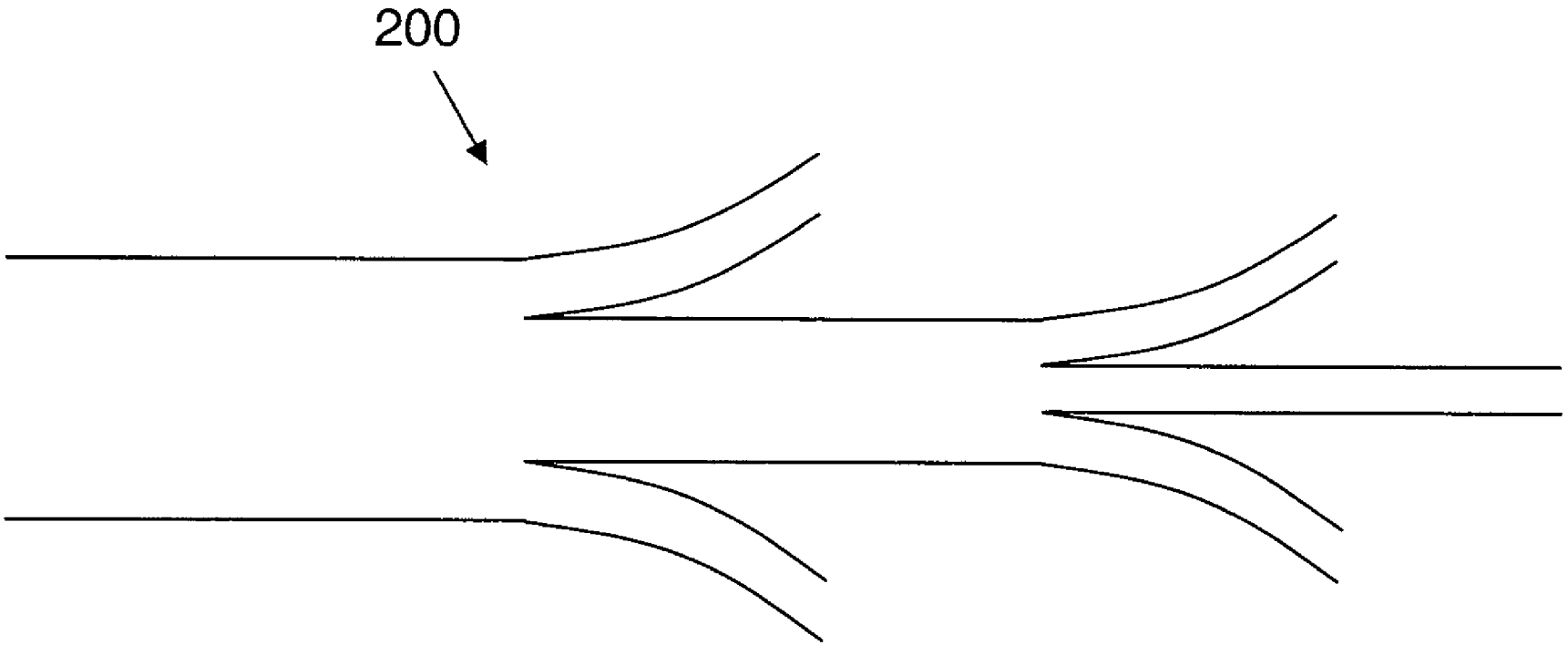
FIG. 5 illustrates a top view of the cable apparatus of FIG. 4 according to an exemplary embodiment of the present invention.

FIG. 4 illustrates a cross-sectional view of a cable apparatus 200 according to yet another embodiment of the present invention. FIG. 5 illustrates a top view of the cable apparatus 200 according to an exemplary embodiment of the present invention. The cable apparatus 200 has a plurality of encapsulated wire sections 201 and a plurality of intermediary sections 202. Each of the encapsulated wire sections 201 includes one or more wires 204. To facilitate installation of the cable apparatus 200, the cable apparatus 200 may be split and branched into an array along the intermediary sections 202 or along the recessed portions 203 between the encapsulated wire sections 201 and intermediary sections 202. Each of the intermediary sections 202 may include a fiberglass reinforced silicone strip 205 to provide a flexible cable apparatus that is less likely to stretch or to tear when force is applied on an attached cable. In this way, cable apparatus 200 may be used to carry the wires from a starting point and then branch out so that certain sections of the cable travel to separate end points, with each section able to be attached to a surface using the intermediary sections.

Figure 6:
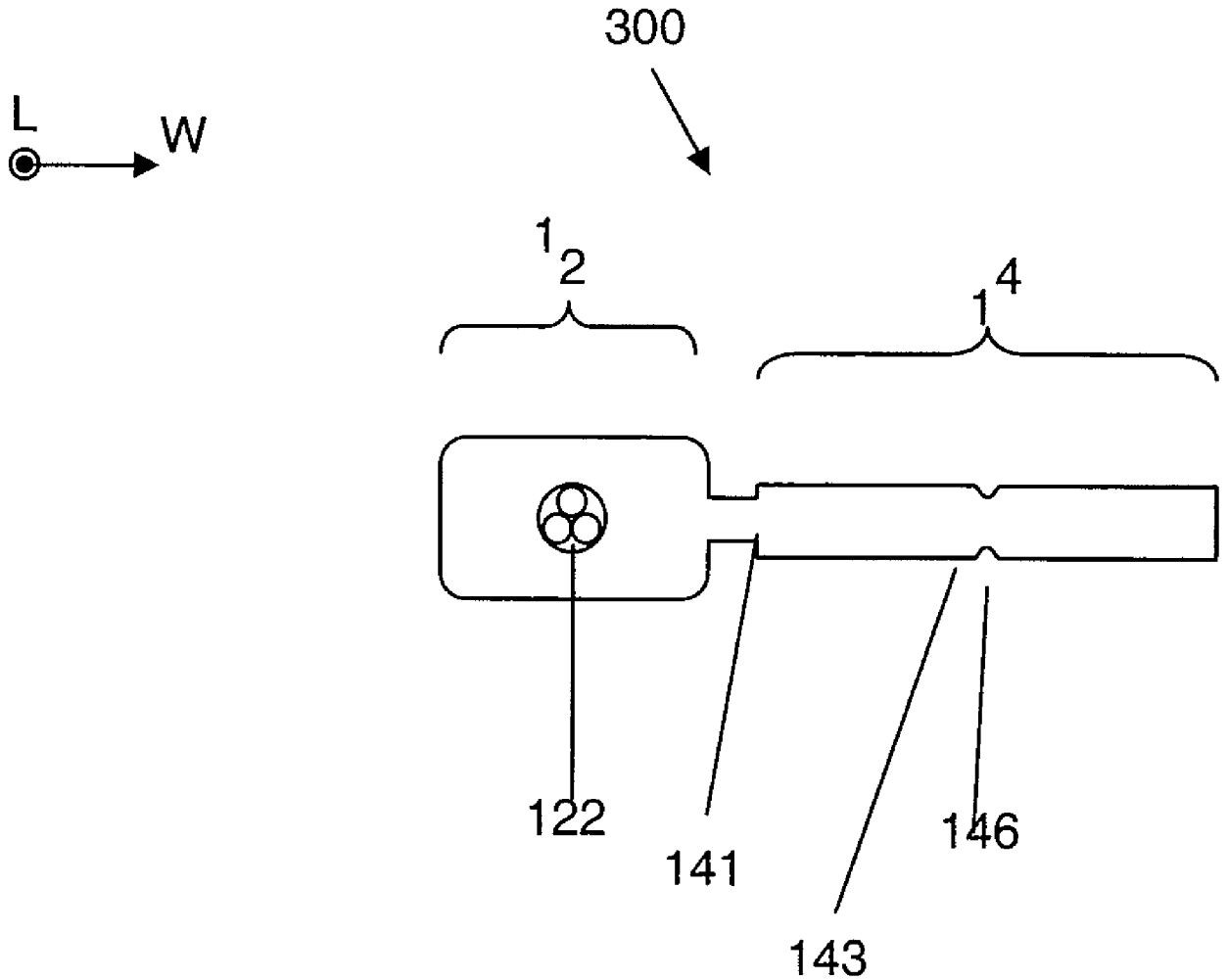
FIG. 6 illustrates a cross-sectional view of a cable apparatus according to another embodiment of the present invention.
Figure 7:
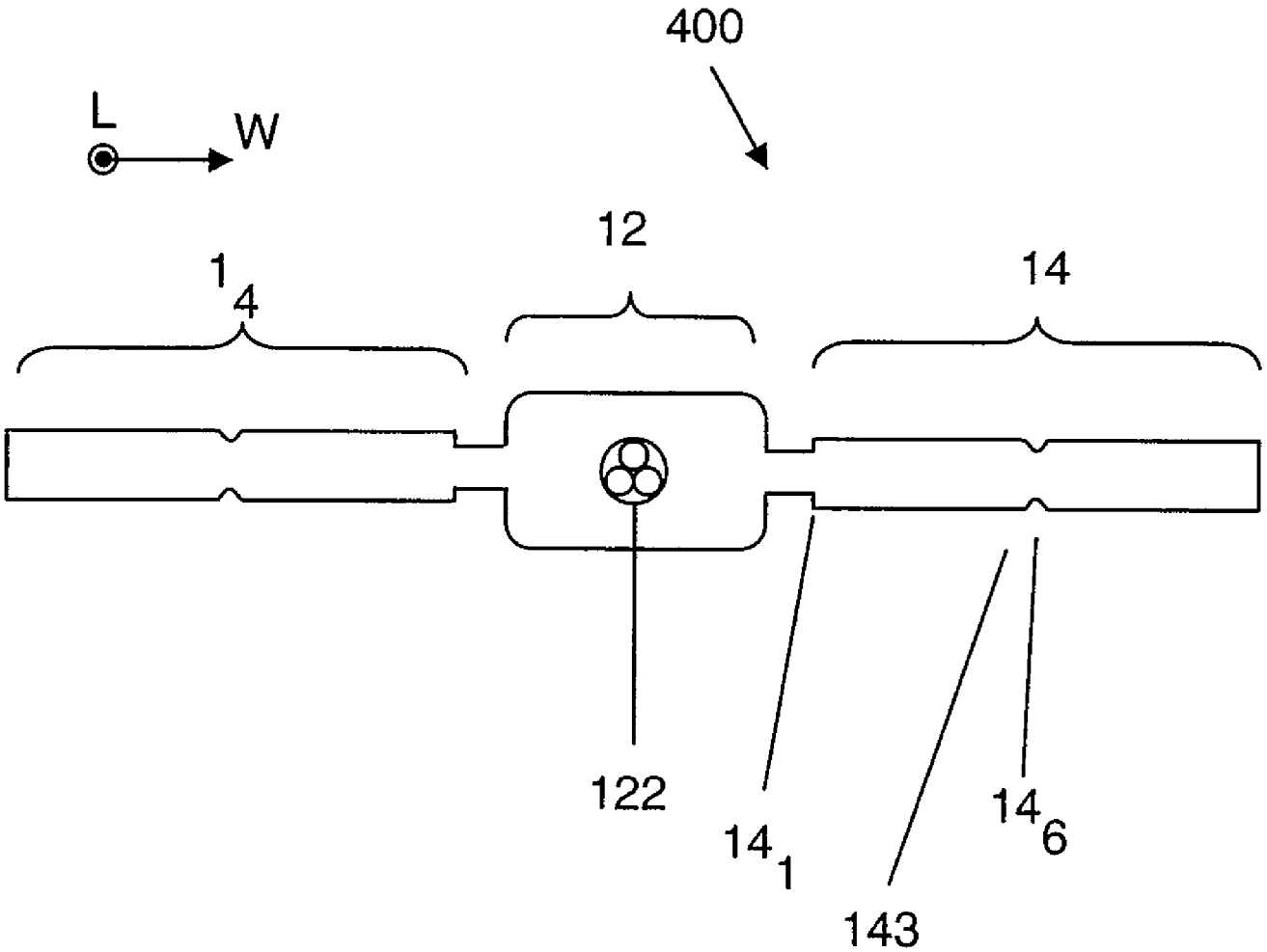
FIG. 7 illustrates a cross-sectional view of a cable apparatus according to yet another embodiment of the present invention.

FIG. 6 illustrates a cross-sectional view of a cable apparatus 300 according to another embodiment of the present invention. FIG. 7 illustrates a cross-sectional view of a cable apparatus 400 according to yet another embodiment of the present invention. As depicted in FIG. 6, the cable apparatus 300 includes an encapsulated wire section 12 and an attached intermediary section 14 without another encapsulated wire section on an opposite side of the intermediary section 14. In this embodiment, if the number of encapsulated wire sections 12 is N, then the number of intermediary sections is also N. In an alternative embodiment, as depicted in FIG. 7, the cable apparatus 400 includes an encapsulated wire section 12 and two attached intermediary sections 14 on both sides of the encapsulated wire section 12. In this embodiment, if the number of encapsulated wire sections 12 is N, then the number of intermediary sections is N+1.

While the invention has been described in terms of exemplary embodiments, it is to be understood that the words which have been used are words of description and not of limitation. As is understood by persons of ordinary skill in the art, a variety of modifications can be made without departing from the scope of the invention defined by the following claims, which should be given their fullest, fair scope.

What is claimed is:

1. A cable apparatus comprising:

a first set of elements extending in a length direction;

a second set of elements extending in the length direction;

encapsulation material encapsulating the first set of elements and the second set of elements;

an intermediary section extending between the first set of elements and the second set of elements, wherein the intermediary section is configured to receive one or more fasteners for securing the cable apparatus to an external surface without the one or more fasteners contacting the first set of elements or the second set of elements;

a band extending in a length direction, the band being located in the intermediary section; and a groove extending down a center of the intermediary section for guiding proper placement of the one or more fasteners and for allowing the intermediary section to be easily separated along the groove.

2. The cable apparatus of claim 1, wherein the encapsulation material is selected from the group consisting of silicone, urethane, polyvinyl chloride, and polytetrafluoroethylene and the intermediary section is formed of the encapsulation material.

3. The cable apparatus of claim 1, wherein the first set of elements and the second set of elements each comprise a wire of an electrically conductive metal.

4. The cable apparatus of claim 3, wherein the first set of elements and the second set of elements each comprise a plurality of wires, the plurality of wires being spaced from each other in a width direction, perpendicular to the length direction.

5. The cable apparatus of claim 1, further comprising:

a first indentation extending in the length direction between the intermediary section and the first set of elements; and a second indentation extending in the length direction between the intermediary section and the second set of elements, wherein the first indentation and the second indentation have a narrower thickness than the intermediary section.

6. The cable apparatus of claim 1, further comprising:

a first barrier protruding from the intermediary section and extending in the length direction along a first edge of the intermediary section; and a second barrier protruding from the intermediary section and extending in the length direction along a second edge of the intermediary section.

7. The cable apparatus of claim 6, wherein the first barrier, the second barrier, and/or the intermediary section is ruled to facilitate positioning the one or more fasteners.

8. The cable apparatus of claim 1, further comprising:

a plurality of additional sets of elements extending in the length direction, the encapsulation material encapsulating the plurality of additional sets of elements; and a plurality of additional intermediary sections extending between each of the plurality of additional sets of elements, and between the second set of elements and one of the plurality of additional sets of elements;

wherein the plurality of additional intermediary sections are configured to receive one or more fasteners for securing the cable apparatus to an external surface without the one or more fasteners contacting the second set of elements or the plurality of additional sets of elements.

9. The cable apparatus of claim 8, further comprising:

a plurality of additional bands extending in a length direction, each of the plurality of additional bands being located in a respective one of the plurality of additional intermediary sections.

10. The cable apparatus of claim 9, wherein the encapsulation material is formed of silicone and the band is a fiberglass reinforced silicone strip.

11. The cable apparatus of claim 9, wherein the intermediary section is transparent and the band is ruled to facilitate positioning of the one or more fasteners.

12. The cable apparatus of claim 9, wherein the band includes a plurality of holes and/or markers for guiding installation of the one or more fasteners.

13. The cable apparatus of claim 8, wherein each of the intermediary section and the plurality of additional intermediary sections has a recess, indentation, or groove extending in the length direction for facilitating splitting and branching the cable apparatus into an array.

14. A cable apparatus comprising:

at least three sets of elements extending in a length direction;

encapsulation material encapsulating the at least three sets of elements, the encapsulation material being formed of silicone;

a plurality of intermediary sections extending between each of the at least three sets of elements, the plurality of intermediary sections being formed of silicone;

a fiberglass reinforced silicone strip within each of the plurality of intermediary sections, the fiberglass reinforced silicone strip extending in the length direction;

wherein the plurality of intermediary sections are configured to receive one or more fasteners extending through the fiberglass reinforced strip within each of the plurality of intermediary sections, the one or more fasteners for securing the cable apparatus to an external surface without the one or more fasteners contacting the at least three sets of elements; and a plurality of barriers protruding from the plurality of intermediary sections and extending in the length direction along edges of each of the plurality of intermediary sections.

15. The cable apparatus of claim 14, further comprising:

a plurality of indentations extending in the length direction between each of the plurality of intermediary sections and a respective one of the at least three sets of elements, the plurality of indentations having a narrower thickness than the plurality of intermediary sections, the plurality of indentations for facilitating splitting and branching the cable apparatus into an array.

16. The cable apparatus of claim 14, wherein the plurality of intermediary sections each have a recess, indentation, or groove extending in the length direction for facilitating splitting and branching the cable apparatus into an array.

17. The cable apparatus of claim 14, wherein the plurality of barriers, the plurality of intermediary sections, and/or the fiberglass reinforced silicone strip within each of the plurality of intermediary sections are ruled to facilitate positioning the one or more fasteners.

18. A cable apparatus comprising:

a first set of elements extending in a length direction;

a second set of elements extending in the length direction;

encapsulation material encapsulating the first set of elements and the second set of elements;

an intermediary section extending between the first set of elements and the second set of elements, wherein the intermediary section is configured to receive one or more fasteners for securing the cable apparatus to an external surface without the one or more fasteners contacting the first set of elements or the second set of elements; and a band extending in a length direction, the band being located in the intermediary section, wherein the band includes a plurality of markers for guiding installation of the one or more fasteners.

* * * * *